US005597324A

United States Patent [19]

Katsunori

[11] Patent Number: 5,597,324

[45] Date of Patent: Jan. 28, 1997

[54] SEALED RECEPTACLE CONNECTOR FOR PC CARD

[75] Inventor: Kasahara Katsunori, Fuchu, Japan

[73] Assignee: Molex Incorporated, Lisle, Ill.

[21] Appl. No.: 497,011

[22] Filed: Jun. 30, 1995

[30] Foreign Application Priority Data

Aug. 2, 1994 [JP] Japan ..... 6-200200

[51] Int. Cl.[6] ..... H01R 13/40

[52] U.S. Cl. ..... 439/587; 439/686

[58] Field of Search ..... 439/76.1, 77, 493, 439/587, 589, 686, 701

[56] References Cited

U.S. PATENT DOCUMENTS 3,829,604 8/1974 Tanaka ..... 439/76.1
4,776,813 10/1988 Wilson et al. ..... 439/587
4,808,115 2/1989 Norton et al. ..... 439/79
5,145,410 9/1992 Maejima et al. ..... 439/587
5,224,875 7/1993 Watanabe et al. ..... 439/587
5,266,045 11/1993 Yamamoto et al. ..... 439/587

*Primary Examiner*—Neil Abrams
*Assistant Examiner*—Barry Matthew L. Standig
*Attorney, Agent, or Firm*—Stacey E. Caldwell

[57] ABSTRACT

Disclosed is an improved receptacle connector for an IC card, which includes a housing having terminal-receiving cavities with terminals mounted therein. Each terminal is fixed to a stopper and the terminal-and-stopper assembly is press-fit within the housing to provide a seal which prevents the ingress of foreign particles into the IC card to avoid contamination of and damage to the circuitry of the internal circuit board of the IC card in which the receptacle connector is assembled.

7 Claims, 8 Drawing Sheets

SEALED RECEPTACLE CONNECTOR FOR PC CARD

FIELD OF THE INVENTION

The present invention relates to an electrical connector, and more particularly, to a receptacle connector for an IC card.

BACKGROUND OF THE INVENTION

FIG. 15 shows a conventional receptacle connector in an assembled IC card 54. As shown in the drawing, receptacle terminals 52 are press-fit in terminal-receiving cavities 53 of a housing 51. Although cover members 58 seal and protect the internal circuit board 56 of the IC card from contaminants and other foreign substances, some moisture and other small size foreign substances may enter the IC card 54 via the cavities 53, as indicated by arrows 55. Therefore there is a potential for contamination of or damage to the integrated circuitry 57 on the surface of internal circuit board 56 of the IC card. The portable nature of IC cards and the removal of the cards from relatively clean areas such as offices further increases the likelihood of the ingress of foreign substances into the IC card.

In an attempt to solve the problem of contamination, it is proposed that housing 51 and terminals 52 are integrally or unitarily formed, such as in a single overmolding process to eliminate cavities 53.

The receptacle connector would then be sealed to the environment except for the smaller inlet apertures 61 at the front mating edge thereof, which receive the contact pins of a mating connector (not shown).

This type of solution however is complicated and costly in terms of design, manufacturing and ultimate cost of the connector.

SUMMARY OF THE INVENTION

An object of the present invention is to provide a sealed receptacle connector for an IC card, which receptacle connector prevents the ingress of foreign contaminants into the IC card, and which does not add significantly to the cost of manufacturing and assembling such receptacle connectors.

To achieve this object, a receptacle connector is provided, which includes an insulative housing, a plurality of inlet apertures at a first end of the housing for receiving contacts of a mating connector, the inlet apertures communicating with terminal-receiving cavities extending rearwardly therefrom, and a corresponding plurality of receptacle terminals inserted in the cavities. Each of the plurality of receptacle terminals is connected to an insulative stopper, and each stopper is adapted to be press-fit within the housing at an opposite end thereof, whereby, when the terminals and stoppers are inserted in the terminal-receiving cavities, the cavities are sealed from the environment by the stoppers.

BRIEF DESCRIPTION OF THE DRAWINGS

Other objects and advantages of the present invention will be understood from the following description of the receptacle connector according to preferred embodiments of the present invention, which are shown in accompanying drawings.

DETAILED DESCRIPTION OF THE PREFERRED EMBODIMENTS

Figure 1:
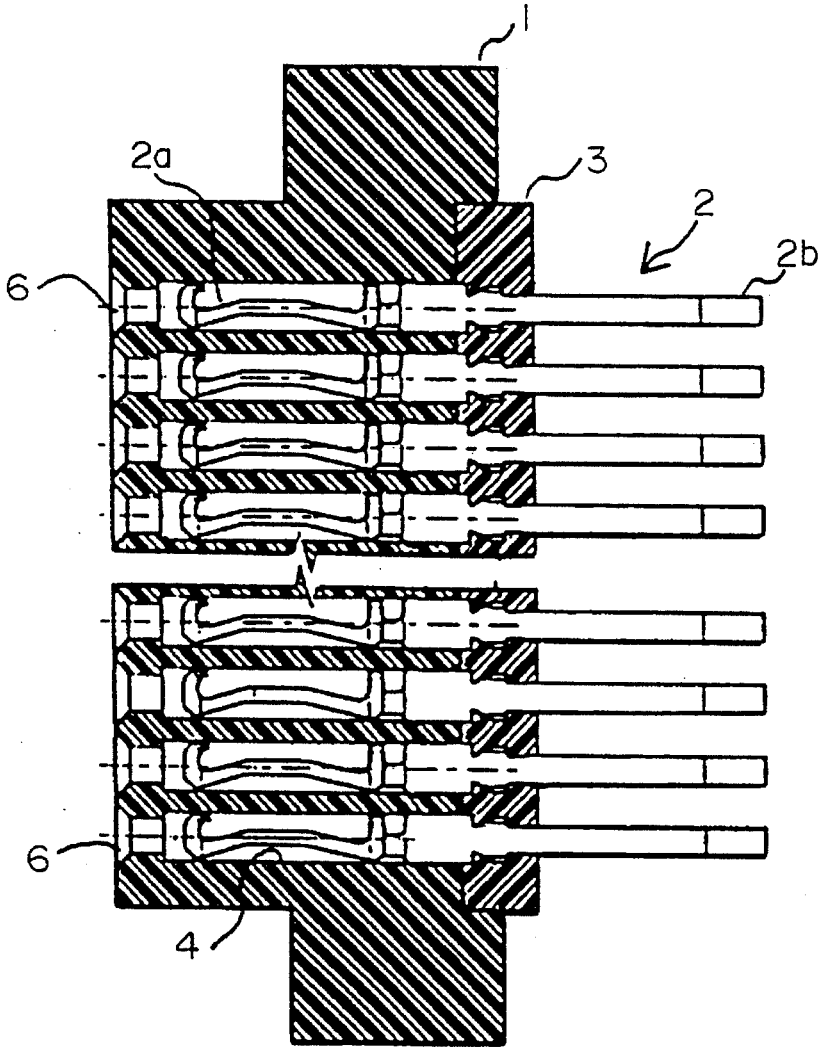
FIG. 1 is a plan view of a receptacle connector according to a first embodiment of the present invention, partly in section.
Figure 2:
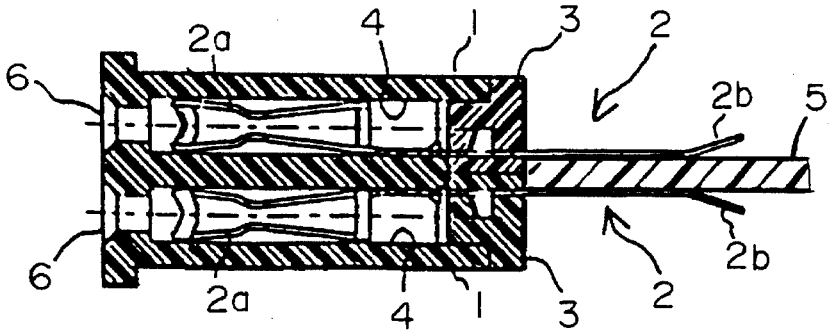
FIG. 2 is a side view of the receptacle connector of the first embodiment, partly in section.

Referring first to FIGS. 1 through 8, a receptacle-type electrical connector according to a first embodiment is described. As shown in FIGS. 1 and 2, the receptacle connector comprises an elongated insulative housing 1, a plurality of receptacle terminals 2 and a corresponding plurality of stoppers 3.

The housing 1 is composed of an upper and a lower row of terminal-receiving cavities 4. The terminals **2*a* are inserted in the upper and lower terminal-receiving cavities 4 of the housing 1 and are adapted to be connected to electronic circuitry (not shown) formed on opposite surfaces of a circuit board 5 of an IC card, thereby permitting the circuitry of the circuit board to be connected to mating contact pins (not shown) when the contact pins are received through inlet apertures 6 of housing 1. The receptacle connector is adapted to be fixed to one end of the circuit board, as shown in FIG. 2**.

As best seen in FIG. 2, the terminal-receiving cavities 4 are sealed at their ends by stoppers 3, thereby preventing the ingress of foreign substances into the IC card through the inlet apertures and the terminal-receiving cavities, and preventing contamination of the internal circuitry of the circuit board.

Figure 3:
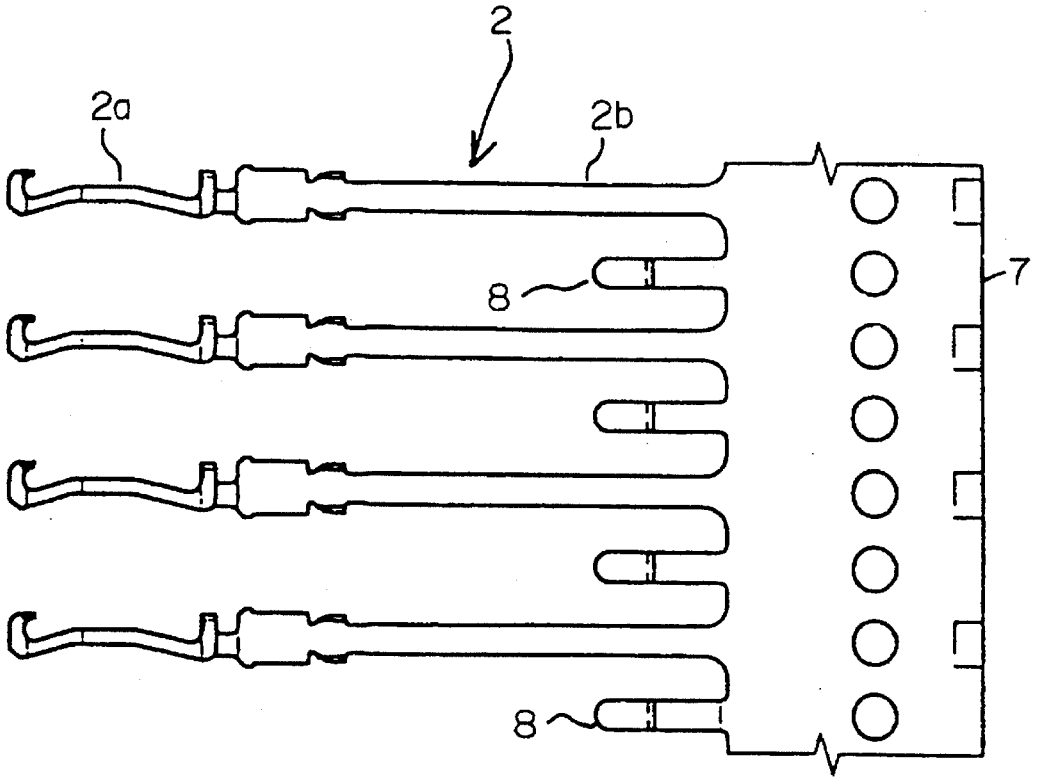
FIG. 3 is a plan view of terminals connected to a carrier strip.
Figure 4:
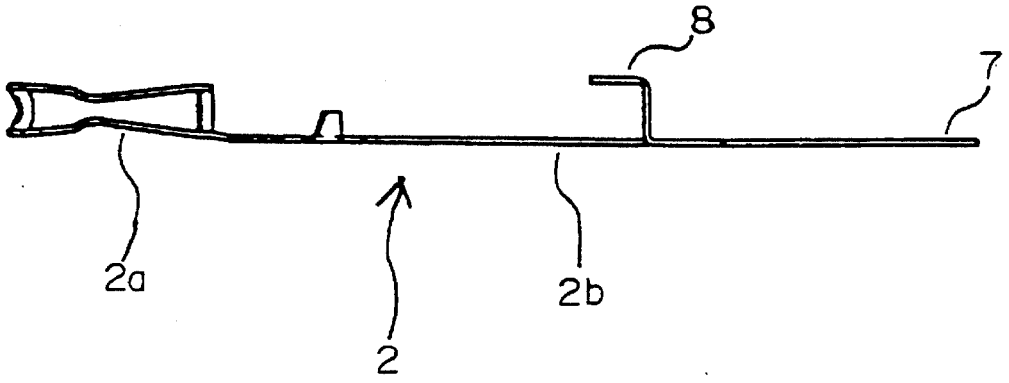
FIG. 4 is a side view of one of the terminals.

Looking now to FIGS. 3 and 4, the terminals are shown prior to assembly of the receptacle connector. The terminals 2 are arranged at a given spacing and connected by a carrier strip 7. Each terminal includes a terminal contact 2*a* at an end opposite the carrier strip, and a conductor extension 2*b* which extends between the terminal contact 2*a* and the carrier strip 7. Guide pieces 8 are arranged between adjacent conductor extensions 2*b*, and also extend from carrier strip 7.

During assembly of the receptacle connector, guide pieces 8 are cut and removed from carrier strip 7, and the terminal contacts 2*a* are arranged at predetermined spacing, for example at intervals of 1.0 mm. The terminals are then insert-molded with the stoppers to form a unitary terminal-and-stopper assembly.

Figure 5:
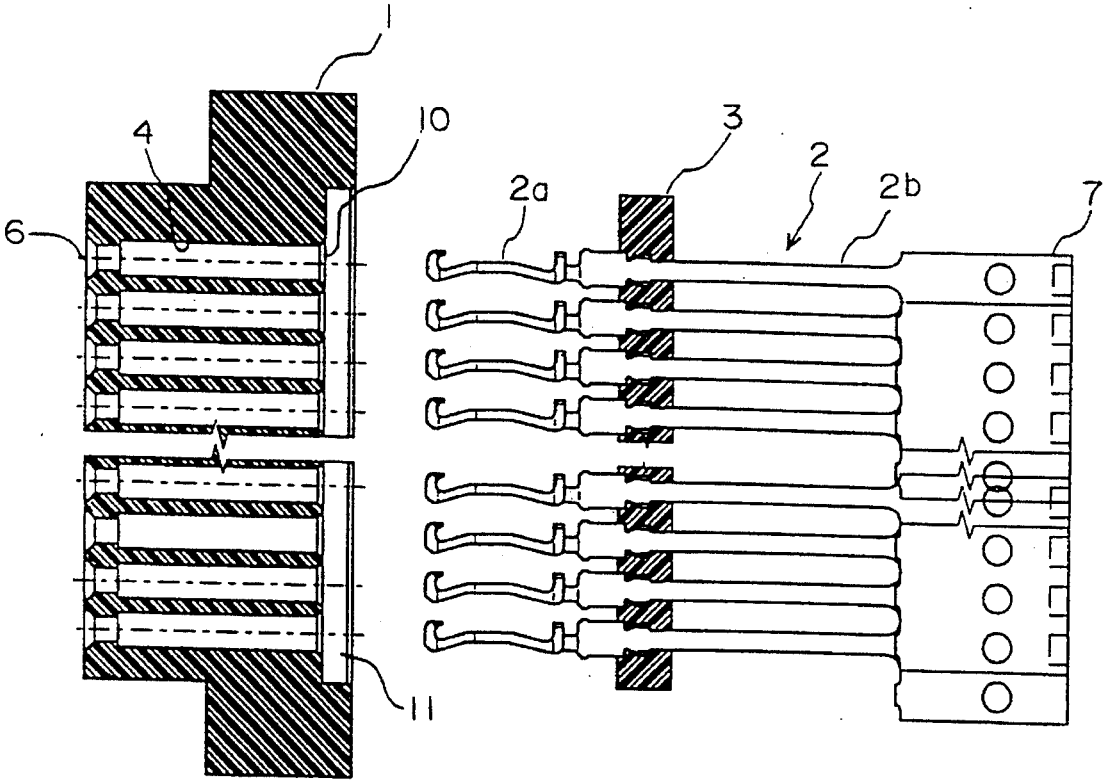
FIG. 5 is a plan view showing, partly in section, how the terminal-and-stopper assembly is inserted into a housing.
Figure 6:
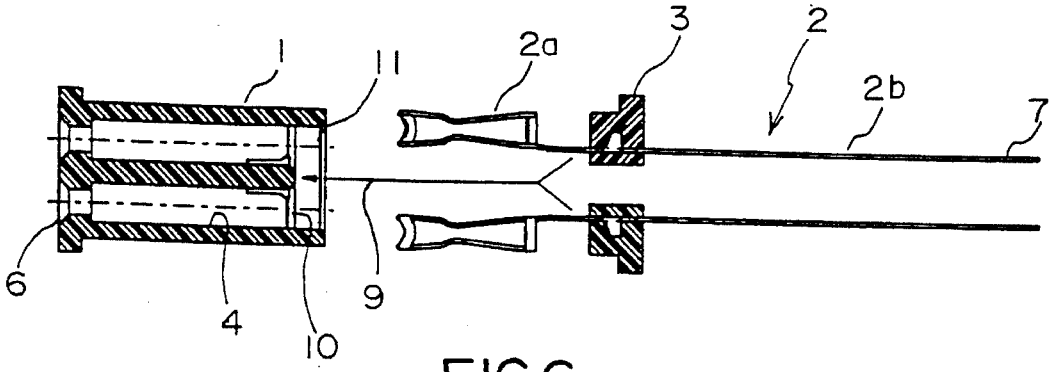
FIG. 6 is a side view showing, partly in section, how the terminal-and-stopper assembly is inserted in the housing.
Figure 7:
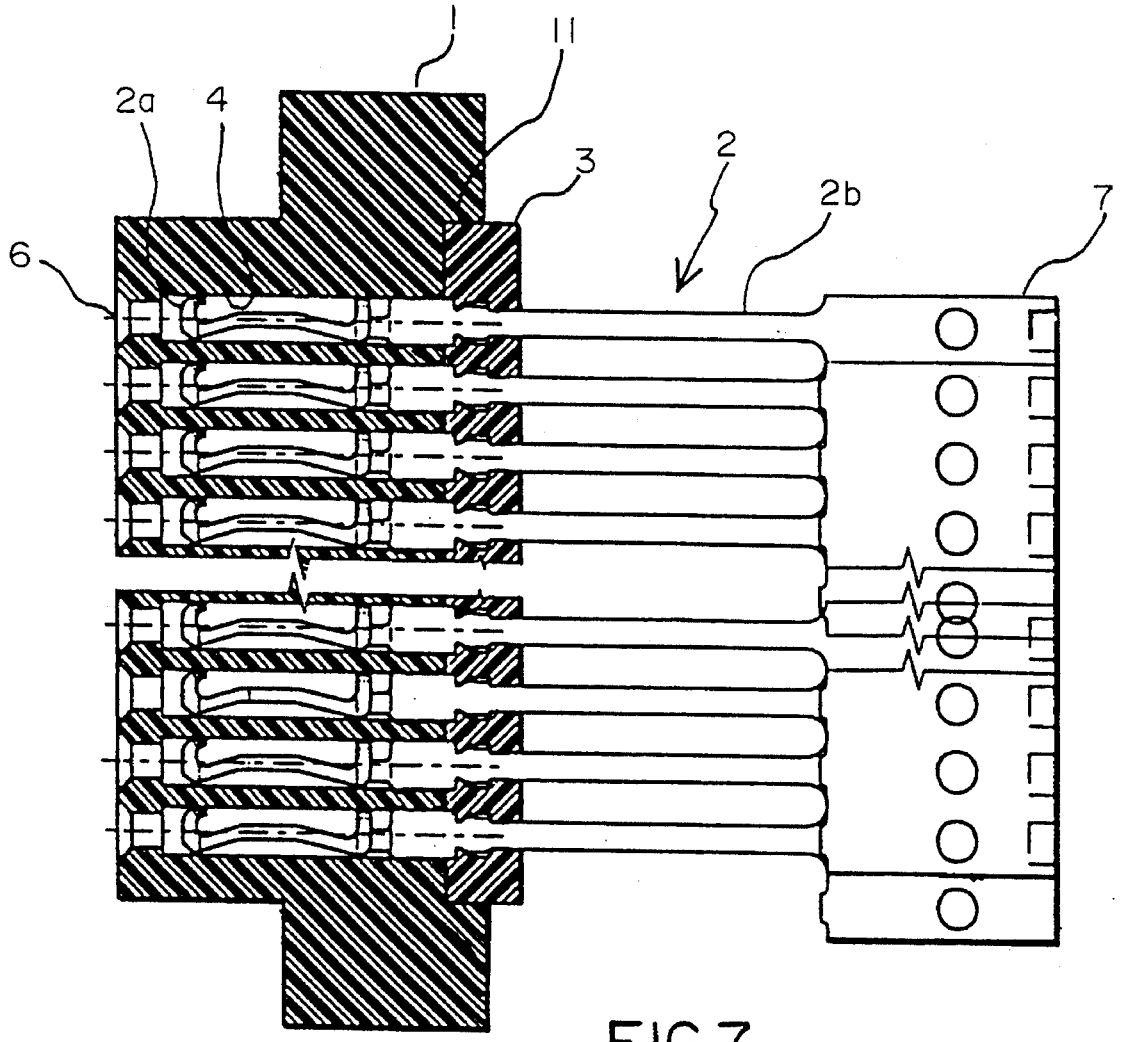
FIG. 7 is a plan view showing, partly in section, the housing with the terminal-and-stopper assembly inserted therein.

The terminal-and-stopper assembly is then press-fit into housing 1 from the rear end thereof by inserting terminal contacts 2*a* into terminal-receiving cavities 4 so that the stoppers are press-fit within a recess or opening 11 of housing 1, as shown in FIGS. 5 and 6. The fully assembled receptacle is shown in FIGS. 7 and 8.

Figure 8:
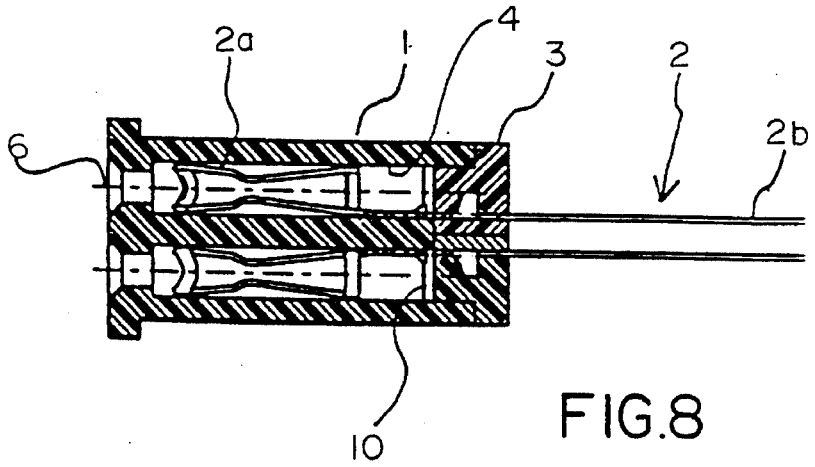
FIG. 8 is a side view showing, partly in section, the housing with the terminal-and-stopper assembly inserted therein.
Figure 9:
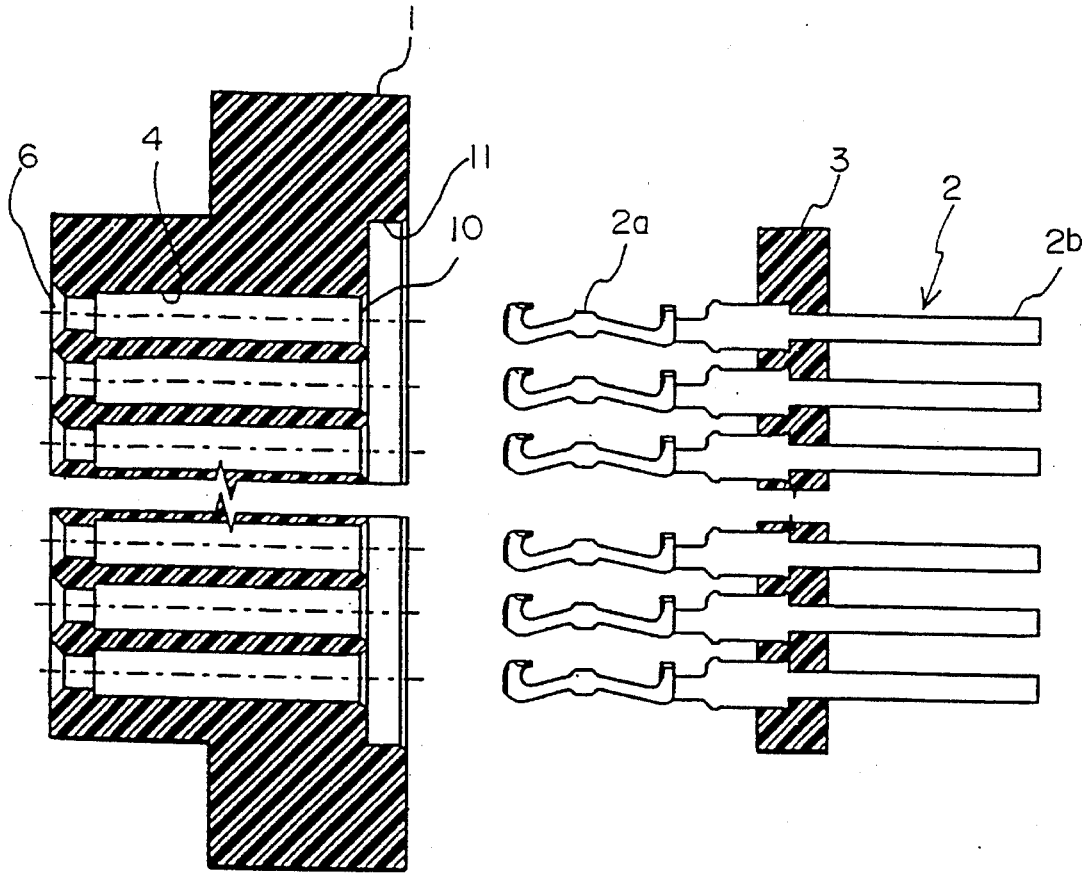
FIG. 9 is a plan view of a receptacle connector according to a second embodiment of the present invention, showing, partly in section, how the terminal-and-stopper assembly is inserted into the housing.

As seen from these drawings, and in particular FIG. 8, the cavities 4 of housing 1 are completely sealed by the stopper 3, which otherwise would permit foreign contaminants into the IC card by way of the terminal-receiving cavities and expose the circuitry of the printed circuit board thereto.

After press-fitting the terminal-and-stopper assembly into the housing, the carrier strip 7 is then cut and removed from the conductive extensions 2*b*, and then, as shown in FIG. 2, the free ends of the conductive extensions 2*b* are formed divergently to facilitate the insertion of the circuit board 5 between the rows of terminals 2 and the soldering of the free ends of the extensions 2*b* to the surface of the circuit board.

Referring now to FIGS. 9 through 12, a receptacle connector is described according to a second embodiment of the invention. In the first embodiment, terminals 2 and associated stoppers 3 are insert-molded to form a single terminal-and-stopper assembly. In the second embodiment, the terminals 2 are simply press-fit within an associated stopper member 3 to provide the unitary terminal-and-stopper assembly.

Figure 10:
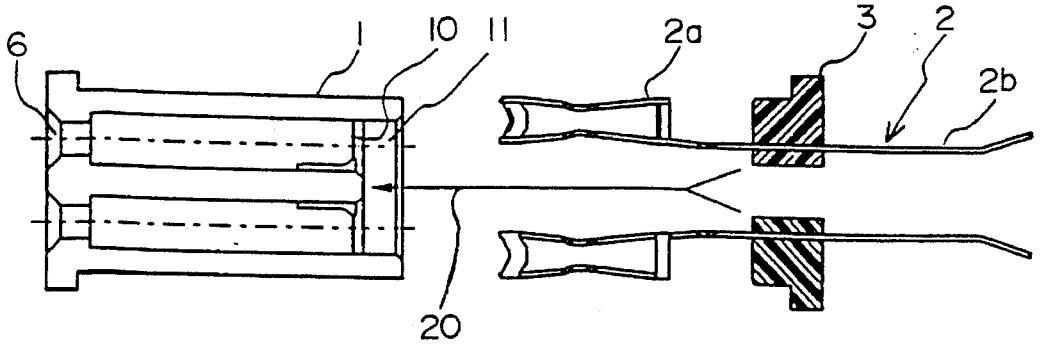
FIG. 10 is a side view of the receptacle connector of the second embodiment, showing, partly in section, how the terminal-and-stopper assembly is inserted into the housing.
Figure 11:
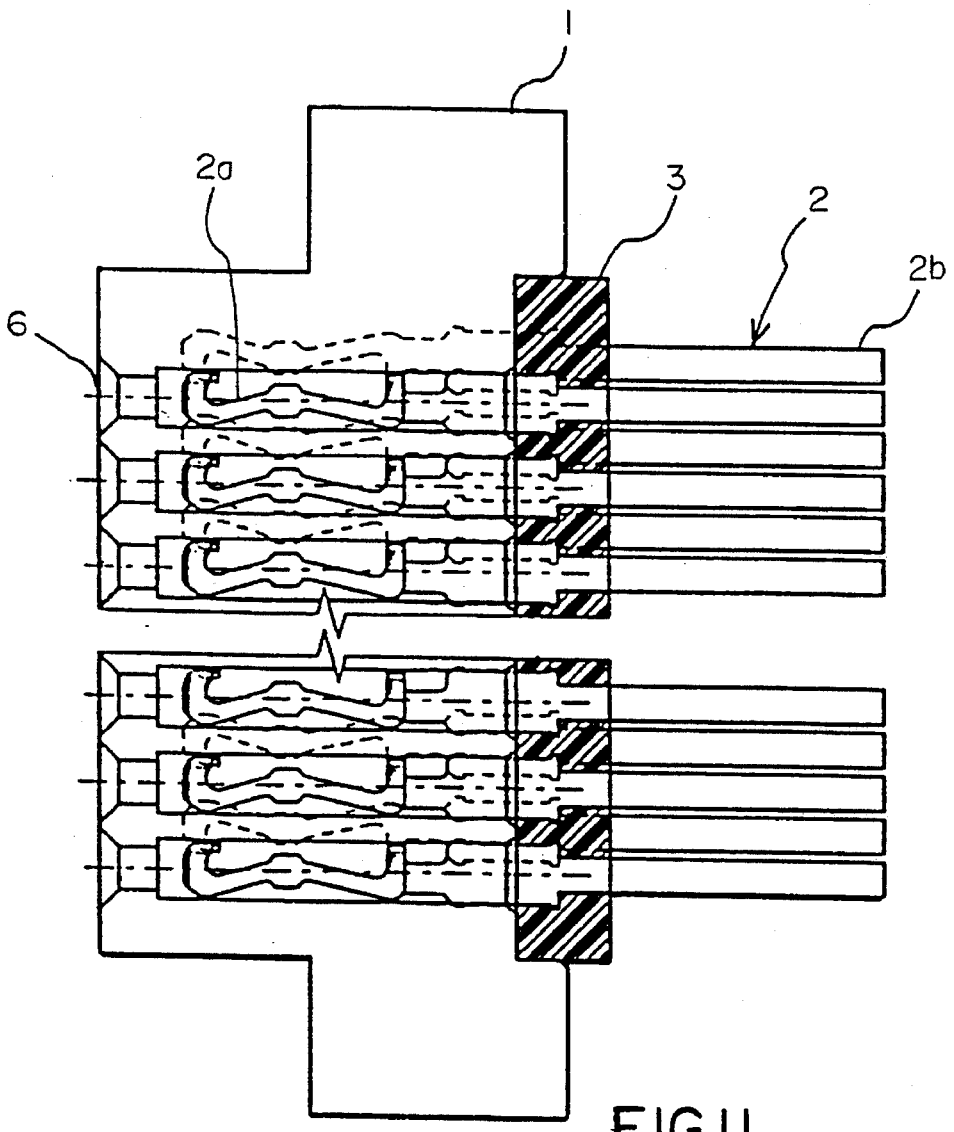
FIG. 11 is a plan view showing, partly in section, the housing having the terminal-and-stopper assembly press-fit there within.
Figure 12:
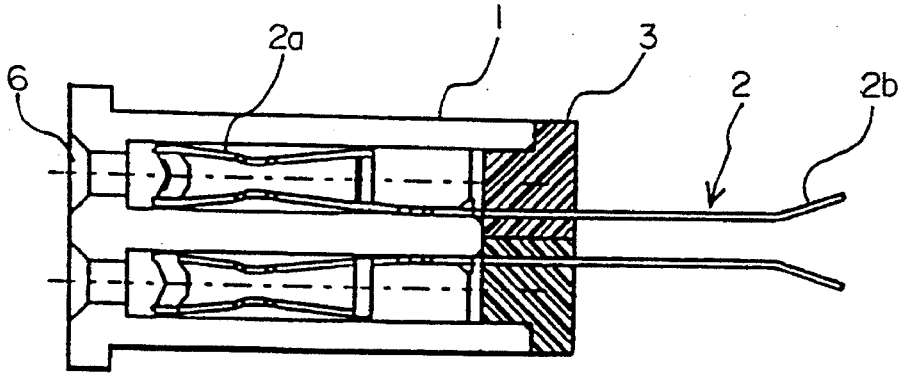
FIG. 12 is a side view showing, partly in section, the housing having the terminal-and-stopper assembly press-fit therein.

As in the first embodiment, the terminal-and-stopper assembly is then press-fit into housing 1 from the rear end thereof, as indicated by arrow 20 in FIG. 10, until stopper 3 is positively fixed or press-fit into recess 11 of housing 1, to provide the receptacle assembly as shown in FIGS. 11 and 12.

Figure 13:
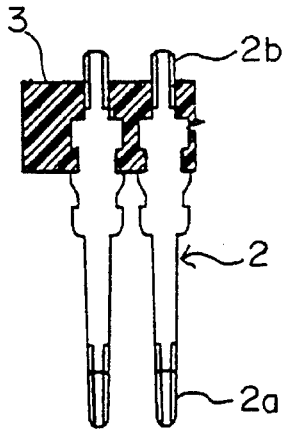
FIG. 13 shows how the terminals and associated stoppers are integrally connected within a receptacle connector according to a third embodiment of the invention.
Figure 14:
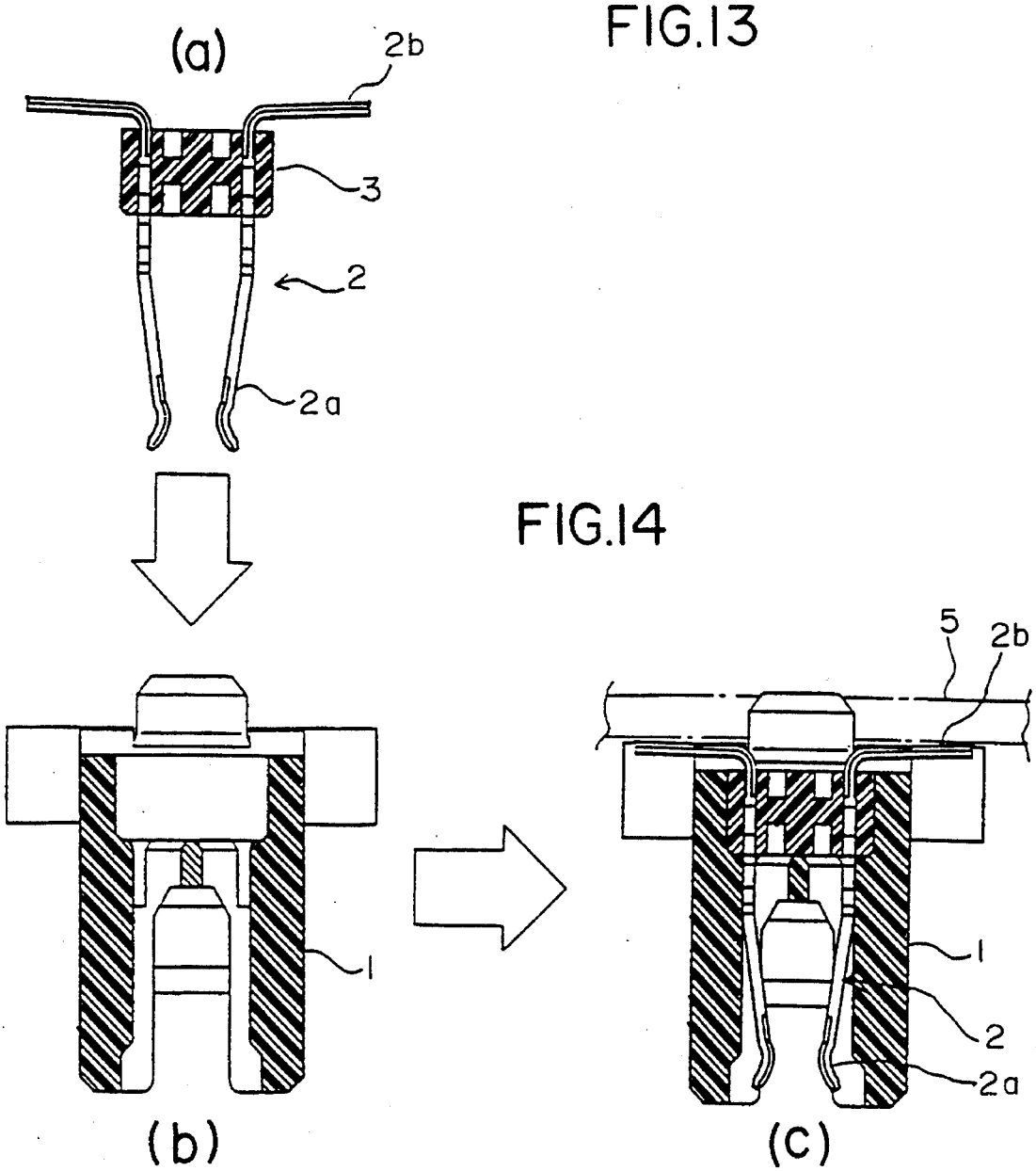
FIG. 14 shows how the terminal-and-stopper assembly is attached to the housing in the receptacle connector of the third embodiment.
Figure 15:
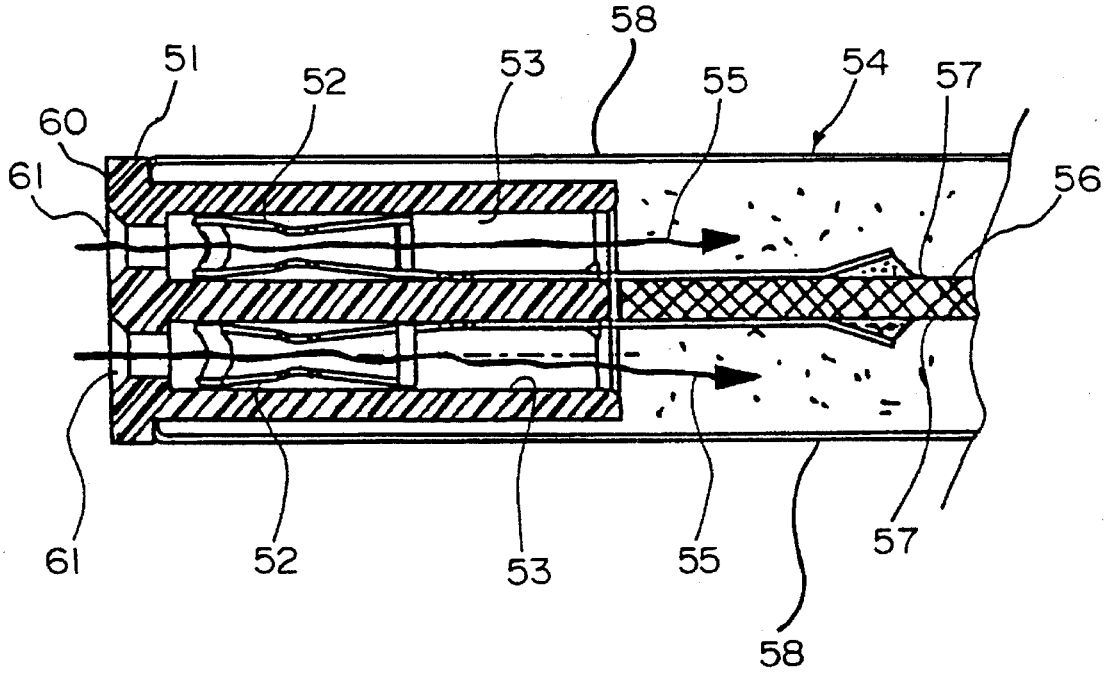
FIG. 15 is a longitudinal section of a conventional receptacle connector.

Next, and now referring to FIGS. 13 and 14, a receptacle connector is described according to a third embodiment of the invention. In the first and second embodiments, the receptacle connector is adapted to be fixed to the end of the circuit board 5 (FIG. 2), but in the third embodiment the receptacle is fixed to the surface of a circuit board 5 (FIG. 14(*c*)).

As shown in FIG. 13, terminals 2 and associated stopper 3 are integrally connected by either method described above, and then, as shown in FIGS. 14*a* and 14*b*, the terminal-and-stopper assembly is assembled within housing 1.

The receptacle is then adapted to be fixed to the surface of the circuit board 5 of an IC card as shown in FIG. 14*c*. Mating contact pins are adapted to be inserted into the receptacle in a direction transverse to the surface of circuit board 5.

As understood from the above, a receptacle connector according to the present invention includes a housing whose terminal-receiving cavities are each sealed by a stopper to prevent the ingress of foreign particles therethrough and to avoid the potential contamination of and/or damage to the circuitry of the internal circuit board of an IC card in which the receptacle connector is assembled.

It will be understood that the above invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A receptacle connector for an IC card, the IC card including a circuit board with electronic circuitry thereon, the receptacle connector comprising:

an elongated housing having a plurality of terminal-receiving cavities extending therethrough, and a plurality of inlet openings formed at a first end of the housing and communicating with the terminal-receiving cavities for receiving contact pins of a mating connector, a plurality of terminals within the terminal-receiving cavities each having a terminal contact for electrically connecting to the contact pins of the mating connector and a generally planar conductor extension extending from the terminal contact with a free end for electrically connecting to the electronic circuitry of the circuit substrate, a plurality of stoppers each attached to a corresponding one of the conductor extensions wherein each stopper is press-fit within the housing at an end opposite the first end, whereby each terminal-receiving cavity is sealed by one of the stoppers to prevent the ingress of foreign particles therethrough.

2. A receptacle connector as set forth in claim 1 wherein the terminal-receiving cavities of the elongated housing and the terminals therein are arranged in two rows.

3. A receptacle connector as set forth in claim 1 wherein the plurality of stoppers are formed in a unitary member which fits within a recess in the opposite end of the elongated housing.

4. A receptacle connector as set forth in claim 1 wherein the terminals are press-fit into the stoppers to form a single terminal-and-stopper assembly and the stoppers retain the terminals in their proper position within the housing.

5. A receptacle connector as set forth in claim 2 wherein the two rows of terminals are defined by an upper row of terminals and a lower row of terminals wherein the conductor extensions of the two rows are adapted to straddle the circuit board of the IC card.

6. A method of fabricating a receptacle connector for an IC card, the receptacle connector including an elongated housing having a plurality of terminal-receiving cavities extending therethrough and a plurality of inlet openings formed at a first end of the housing in communication with the terminal-receiving cavities for receiving contact pins of a mating connector, a plurality of terminals in the form of a terminal strip having a terminal contact adapted for positioning within the terminal-receiving cavities and a generally planar conductor extension extending from the terminal contact with a free end adapted for connecting to a circuit board, and a plurality of stoppers each corresponding to one of the plurality of terminals and adapted to be press-fit within an end opposite the first end of the housing, the method comprising the steps of:

a) overmolding the strip of terminals to the stoppers to provide a unitary terminal-and-stopper assembly;

b) inserting the terminal-and-stopper assembly into the opposite end of the housing so that each of the terminal contacts is positioned within a corresponding terminal-receiving cavity and spaced from its corresponding inlet opening; and c) fixing the stoppers within a recess in the housing wherein the terminals are properly positioned within the housing to receive the mating pins of a mating connector and wherein the terminal-receiving cavities are each sealed at the opposite end by a corresponding stopper to prevent the ingress of foreign substances therethrough.

7. A receptacle connector as set forth in claim 1 wherein the terminal contacts of the terminals are spaced from the inlet openings toward the opposite end of the housing.

* * * * *